US005806190A

United States Patent [19]

Robitaille

[11] Patent Number: 5,806,190

[45] Date of Patent: Sep. 15, 1998

[54] HANDLE CUTTER ASSEMBLY

[76] Inventor: Lionel L Robitaille, 5726 Kilmore Cres E., Surrey BC, Canada, V3S-6G1

[21] Appl. No.: 783,351

[22] Filed: Jan. 16, 1997

[51] Int. Cl.[6] ..... B25F 1/00

[52] U.S. Cl. ..... 30/143; 30/316

[58] Field of Search ..... 30/2, 142, 315, 30/316, 358, 359, 360, 143, 146

[56] References Cited

U.S. PATENT DOCUMENTS

| | | | |
|---|---|---|---|
| 2,152,063 | 3/1939 | Klumb | 30/315 |
| 4,010,543 | 3/1977 | Nusbaum | 30/316 |
| 4,494,426 | 1/1985 | Hartzell | 83/164 |
| 4,607,553 | 8/1986 | Hartzell | 83/164 |
| 4,689,885 | 9/1987 | Albanese | 30/316 |
| 5,020,220 | 6/1991 | Miyake et al. | 30/2 |
| 5,430,940 | 7/1995 | Lym | 30/146 |

FOREIGN PATENT DOCUMENTS

| | | | |
|---|---|---|---|
| 80689 | 7/1951 | Czechoslovakia | 30/358 |

*Primary Examiner*—Hwei-Siu Payer

[57] ABSTRACT

A new Handle Cutter Assembly used in the packaging and shipping of things in cardboard boxes and the like. The inventive device includes a handle, a cutter for cutting handle slots, and an exacto knife. In use, the Handle Cutter Assembly is pushed against a wall of material such as cardboard or the like. Since the surface area of the cutting edge is reduced due to the high or pointed edges along with the low edges, the cutter readily penetrates the surface of the material. As the cutter is pushed through the material, the low edges approach and eventually cut as well. The cutter does not go completely around as in an oval, but rather it is shaped like a "C" and has one side left open. This remaining open side consequently does not cut the material adjacent to this area of the cutter for the purpose of leaving the material intact and to be folded over. In some cases, this remaining flap can still be relied upon to hold material into the box and it can also serve as a more pleasant edge for the hand to lift against. The Handle Cutter Assembly can effectively be used either side up to create handle holes and flaps to the advantage of the user according to the material being carried or packed inside the box or object.

15 Claims, 6 Drawing Sheets

FIG 3
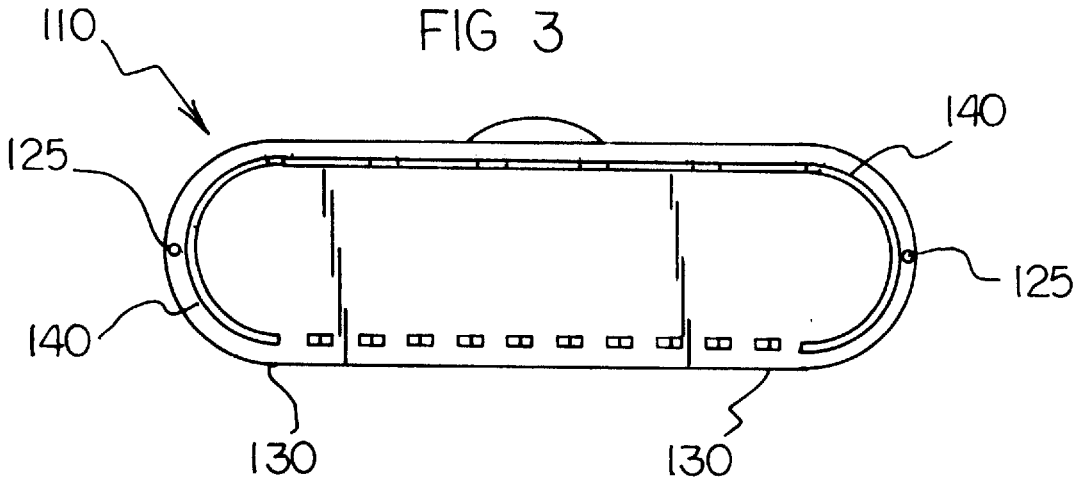
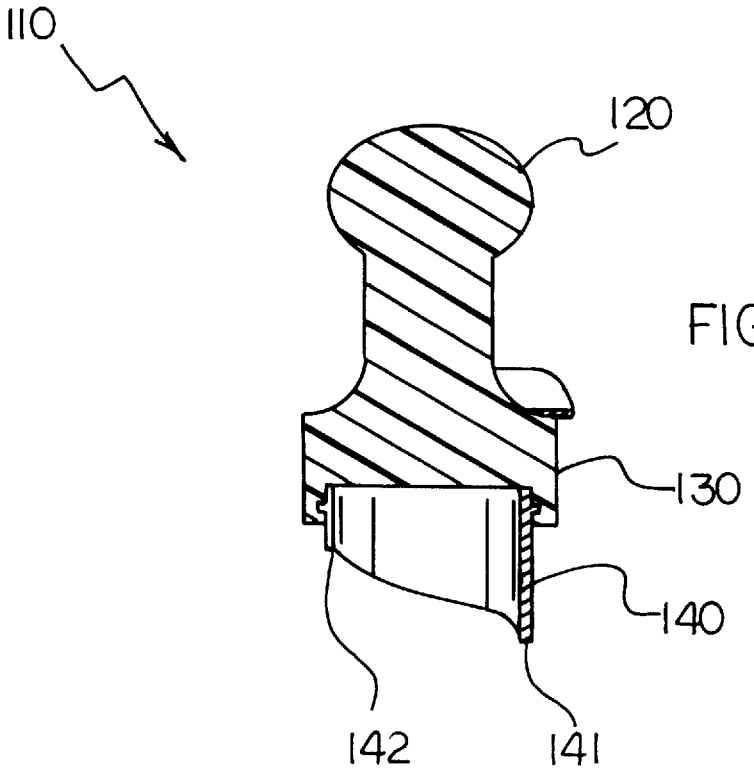
FIG 4

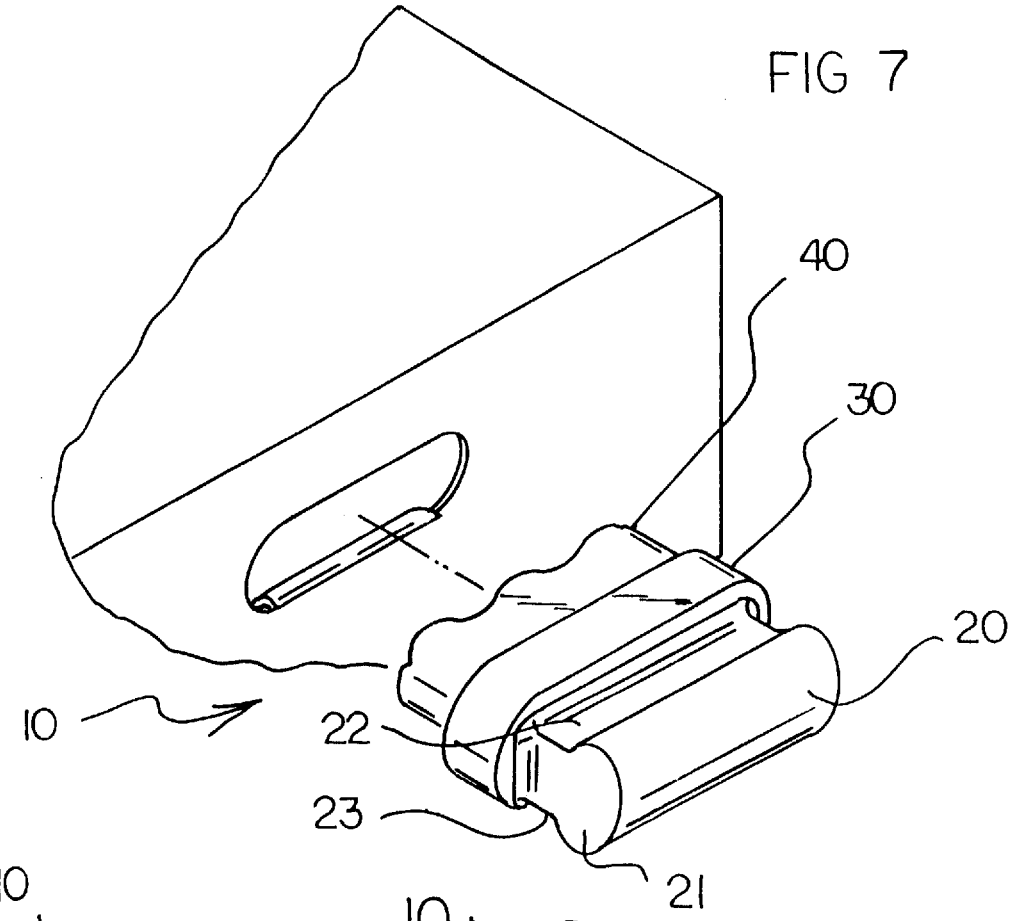
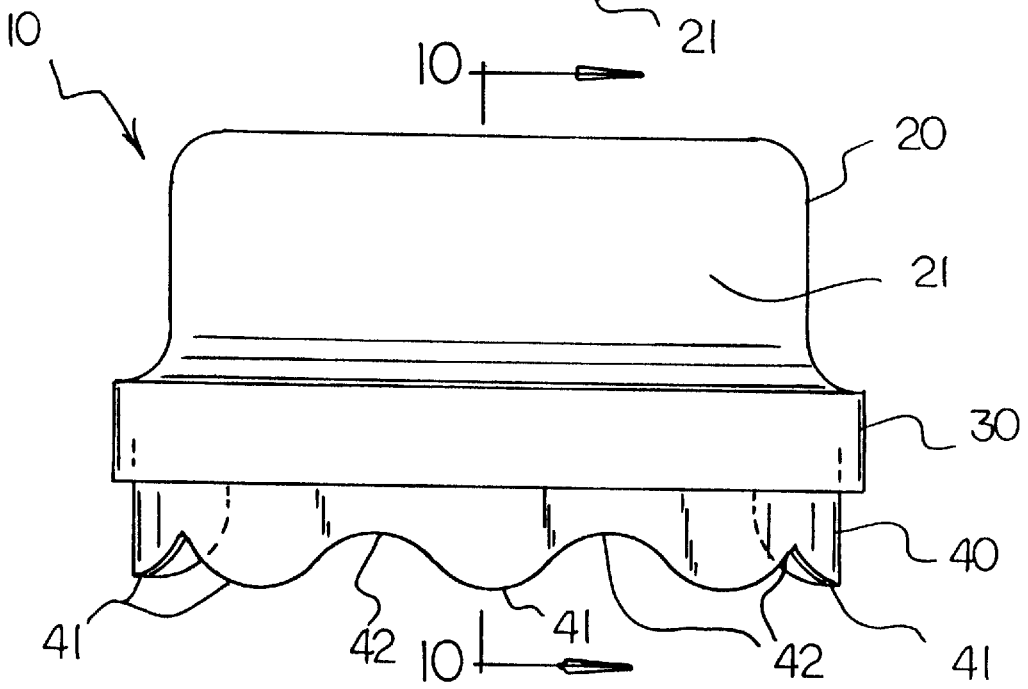
FIG 8

FIG 9
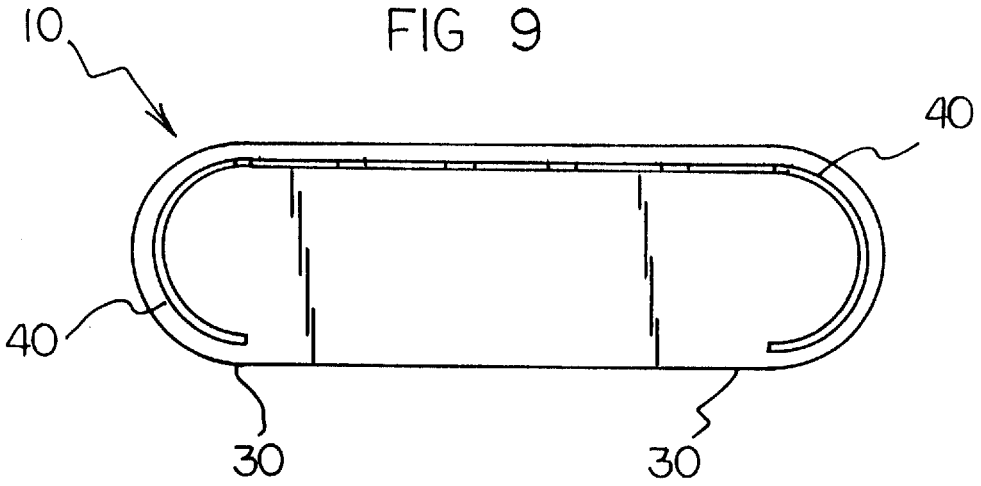
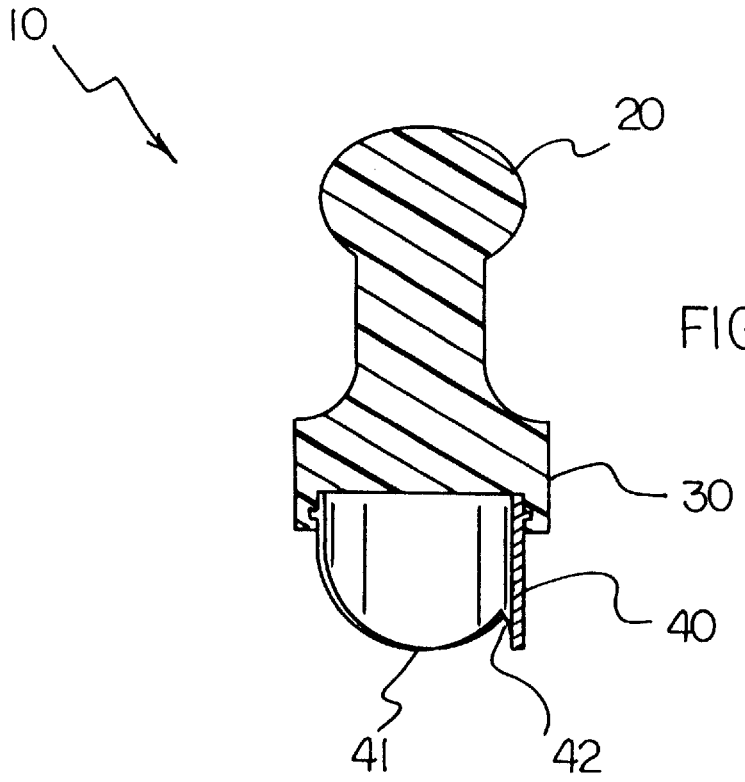
FIG 10

HANDLE CUTTER ASSEMBLY

BACKGROUND OF THE INVENTION

1. Field of the Invention

The present invention relates to the art of packaging tools used in the packaging and shipping of things in cardboard boxes and the like and more particularly pertains to a new Handle Cutter Assembly for the purpose of cutting handle holes into a cardboard box.

2. Description of the Prior Art

The use of packaging tools used in the packaging and shipping of things in cardboard boxes and the like is known in the prior art. More specifically, packaging tools used in the packaging and shipping of things in cardboard boxes and the like heretofore devised and utilized are known to consist basically of familiar, expected and obvious structural configurations, notwithstanding the myriad of designs encompassed by the crowded prior art which have been developed for the fulfillment of countless objectives and requirements.

Known prior art packaging tools used in the packaging and shipping of things in cardboard boxes and the like include U.S. Pat. No. 4,607,553 issued to Hartzell on Aug. 26, 1986; U.S. Pat. No. 4,494,426 issued to Hartzell on Jan. 22, 1985; U.S. Pat. No. 4,009,625 issued to Pfaff on Mar. 1, 1977; U.S. Pat. No. 4,031,616 issued to Hines et al. on Jun. 28, 1977; U.S. Pat. No. 4,771,539 issued to Bengsch on Sep. 20, 1988; and U.S. Pat. Des. No. 290,333 issued to Pashley on Jun. 16, 1987. The Hatzell patent '553 is considered to be the most relevant because it effectively discloses a device that performs a similar function as the present invention. However, the structure of the Hartzell '553 device is different from the present invention. The Hartzell '426 and the Pfaff devices are also considered to be relevant because they also perform similar functions. The patents to Hines et al., Bengsch, and Pfaff are cited only as being of general interest.

These prior devices, being substantially within the last 10 years or so indicate a long felt desire to improve the art of conveniently cutting handle holes and the like into cardboard, etc. While these devices fulfill their respective, particular objectives and requirements, the aforementioned patents do not disclose a new Handle Cutter Assembly. The inventive device includes a handle, a cutter for cutting handle slots, and an extendable knife.

In these respects, the Handle Cutter Assembly according to the present invention substantially departs from the conventional concepts and designs of the prior art, and in so doing provides an apparatus primarily developed for the purpose of offering packaging tools used in the packaging and shipping of things in cardboard boxes and the like.

SUMMARY OF THE INVENTION

In view of the foregoing disadvantages inherent in the known types of Packaging Devices now present in the prior art, the present invention provides a new Handle Cutter Assembly construction wherein the same can be utilized for offering packaging tools used in the packaging and shipping of things in cardboard boxes and the like.

The general purpose of the present invention, which will be described subsequently in greater detail, is to provide a new Handle Cutter Assembly apparatus and method which has many of the advantages of the Packaging Devices mentioned heretofore and many novel features that result in a new Handle Cutter Assembly which is not anticipated, rendered obvious, suggested, or even implied by any of the prior art Packaging Devices, either alone or in any combination thereof.

To attain this, the present invention generally comprises a handle, a cutter for cutting handle slots, and an extendable knife.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Handle Cutter Assembly apparatus and method which has many of the advantages of the Packaging Devices mentioned heretofore and many novel features that result in a new Handle Cutter Assembly which is not anticipated, rendered obvious, suggested, or even implied by any of the prior art Packaging Devices, either alone or in any combination thereof.

It is another object of the present invention to provide a new Handle Cutter Assembly which may be easily and efficiently manufactured and marketed.

It is a further object of the present invention to provide a new Handle Cutter Assembly which is of a durable and reliable construction.

An even further object of the present invention is to provide a new Handle Cutter Assembly which is susceptible of a low cost of manufacture with regard to both materials and labor, and which accordingly is then susceptible of low prices of sale to the consuming public, thereby making such Handle Cutter Assembly economically available to the buying public.

Still yet another object of the present invention is to provide a new Handle Cutter Assembly which provides in the apparatuses and methods of the prior art some of the advantages thereof, while simultaneously overcoming some of the disadvantages normally associated therewith.

Still another object of the present invention is to provide a new Handle Cutter Assembly for offering packaging tools used in the packaging and shipping of things in cardboard boxes and the like.

Yet another object of the present invention is to provide a new Handle Cutter Assembly which includes a handle, a cutter for cutting handle slots, and an extendable knife.

Even still another object of the present invention is to provide a new Handle Cutter Assembly wherein handle holes may be easier, more efficiently, and more effectively cut into in cardboard boxes.

Yet another object of the present invention is to provide a new Handle Cutter Assembly that allows easier handling and lifting of boxes and the like and does not cause the user to bend over as far and therefore prevents some risk of back injury.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a bottom view of the present invention.

FIG. 4 is a cross sectional view taken along line 4—4 of FIG. 2 of the invention.

FIG. 7 is a right side perspective view of an alternate embodiment of a Handle Cutter Assembly and the handle hole that it would make according to the present invention.

FIG. 8 is a side elevation view of the alternate embodiment.

FIG. 9 is a bottom view of the alternate embodiment.

FIG. 10 is a cross sectional view taken along line 10—10 of FIG. 8 of the invention.

DESCRIPTION OF THE PREFERRED EMBODIMENT

Figure 1:
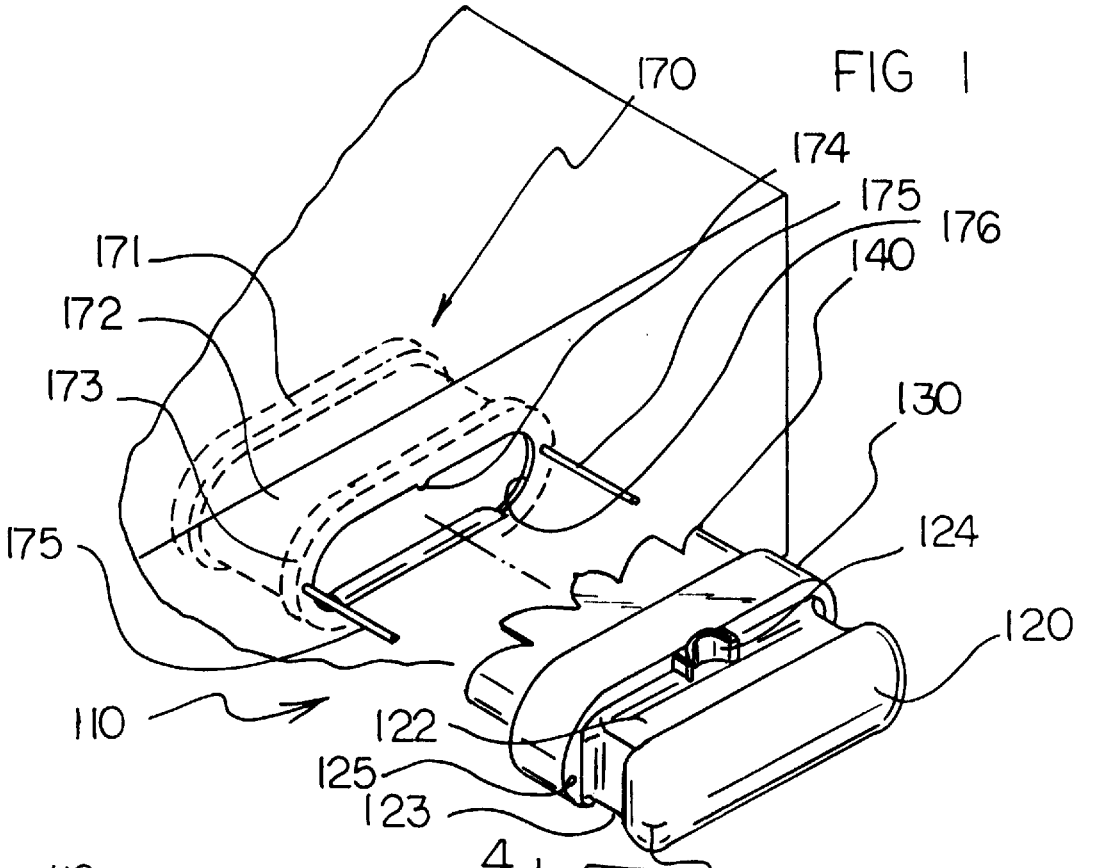
FIG. 1 is a right side perspective view of a new Handle Cutter Assembly and the handle hole that it would make according to the present invention.
Figure 2:
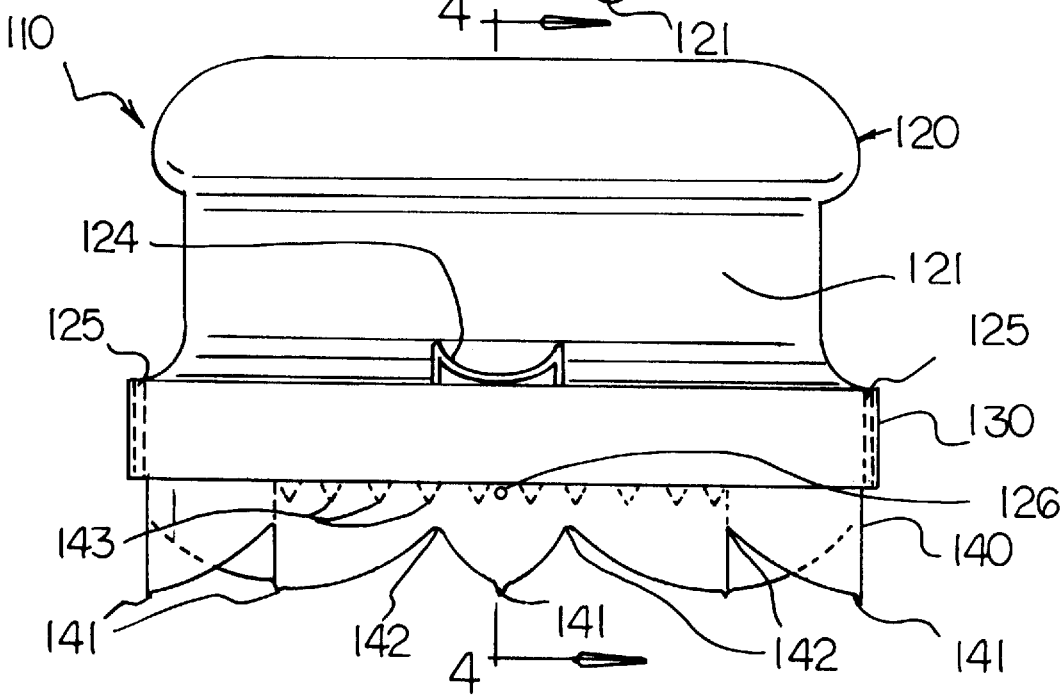
FIG. 2 is a side elevation view thereof.
Figure 5:
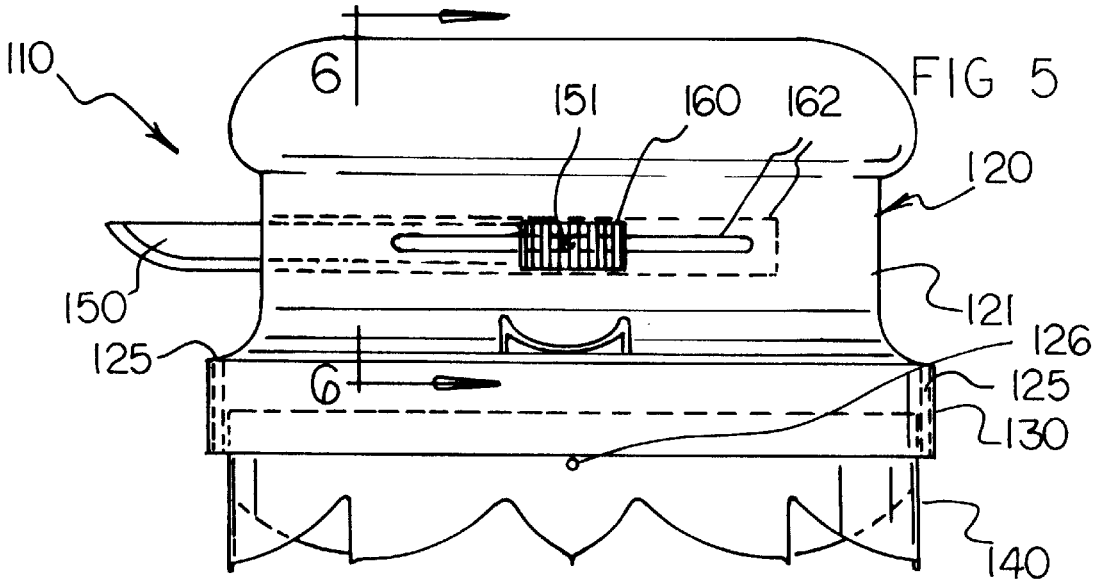
FIG. 5 is a side elevation view illustrating the thumb operated extendable knife in its extended setting.
Figure 6:
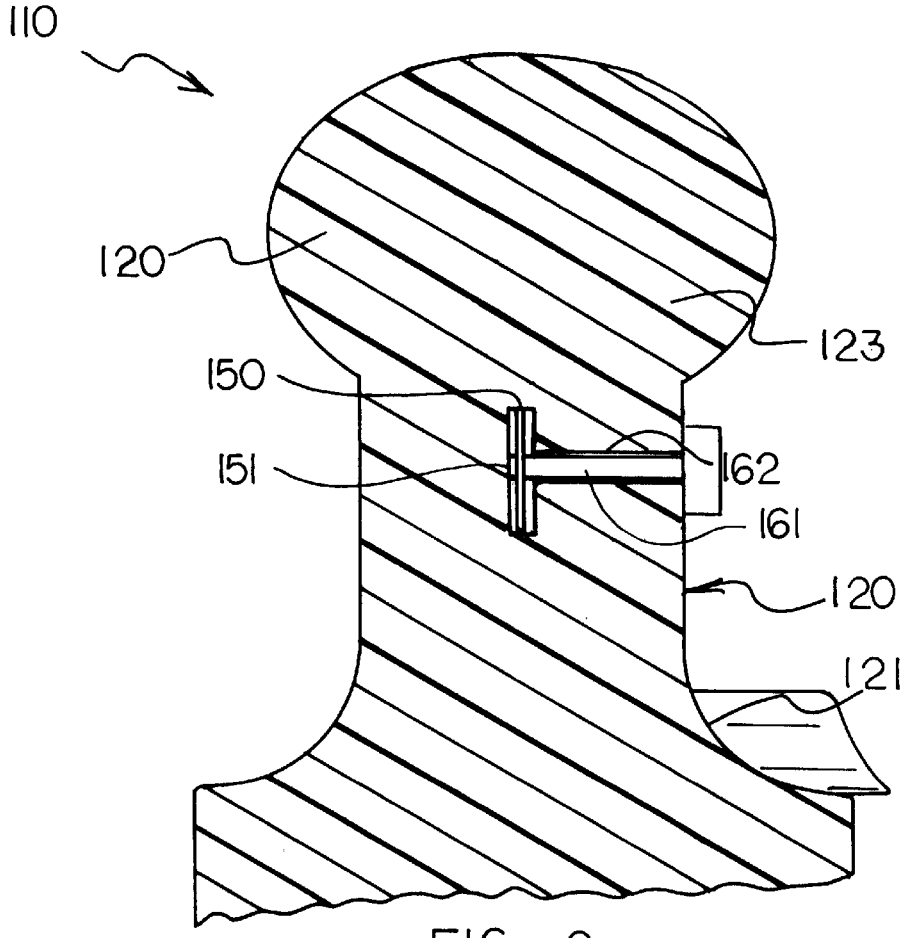
FIG. 6 is an enlarged cross sectional view taken along line 6—6 of FIG. 5.
Figure 11:
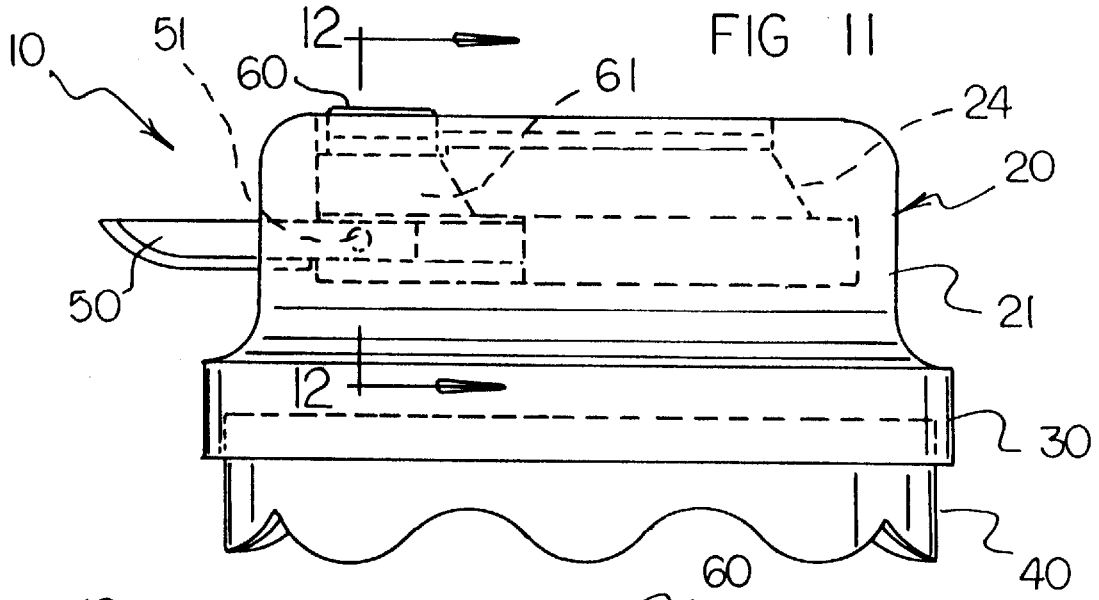
FIG. 11 is a side elevation view of the alternate embodiment illustrating the thumb operated extendable knife in its extended setting.
Figure 12:
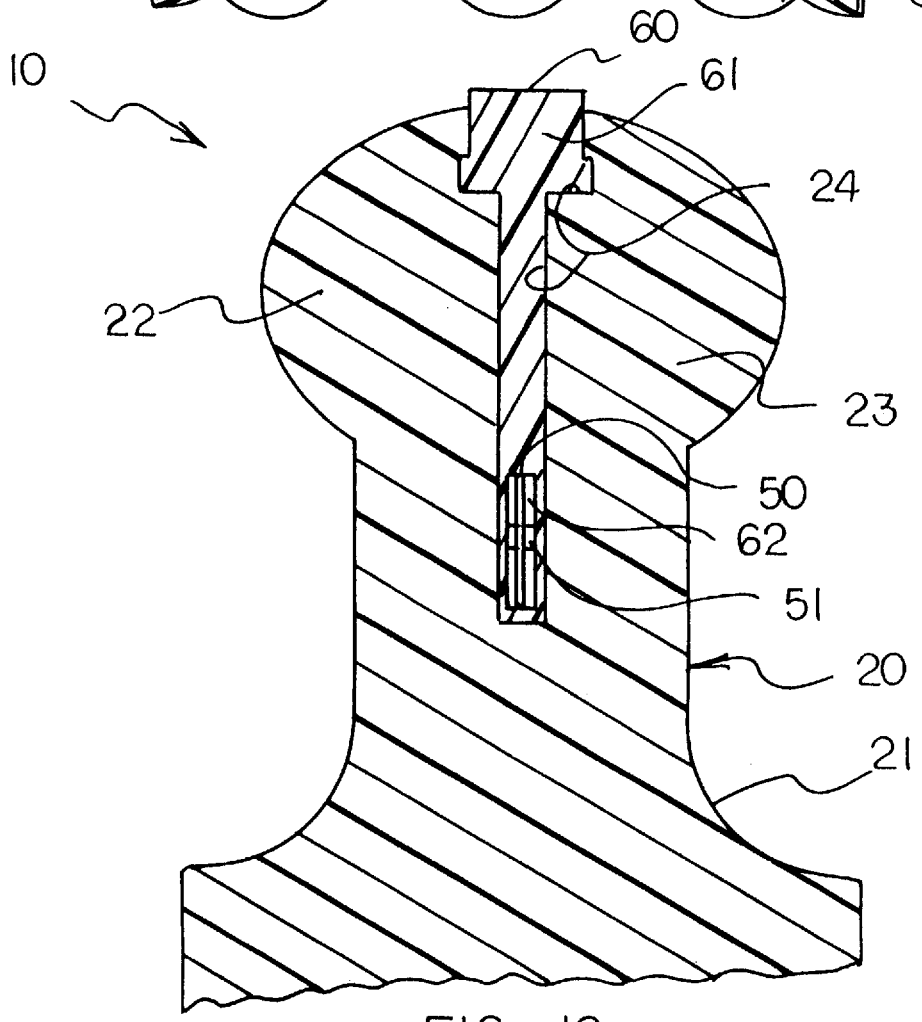
FIG. 12 is an enlarged cross sectional view taken along line 12—12 of FIG. 11.

With reference now to the drawings, and in particular to FIGS. 1 through 12 thereof, a new Handle Cutter Assembly embodying the principles and concepts of the present invention and generally designated by the reference numerals 10 and 110 will be described.

More specifically, it will be noted that a preferred embodiment of the Handle Cutter Assembly 110 comprises a handle 120, a base 130, a cutter 140, and an extendable knife 150 controlled by a thumb control 160.

As best illustrated in FIGS. 1 through 6, it can be shown that the handle 120 is an integral part of the base 130 and is an extension thereof on one side of the base 130, and the cutter 140 is also an integral part of the base 130 and extends in a direction opposite of the handle 120 from the base 130. The handle 120 further comprises a shell 121 which is formed by a left shell 122 and a right shell 123 which are joined together. The cutter 140 is fastened to the base 130 on a side opposite the handle 120. The cutter 140 is formed with a cutting edge that is formed with high points 141 and low crevices 142 such that only high points 141 initially contact the surface being cut when the hand cutter assembly is used. The handle further includes an extendable knife 150 for use in additional cutting. The extendable knife 150 is retractable by operation of a thumb control 160. The thumb control 160 further comprises a slide bar 161 which extends away from the thumb of a user through an aperture 162 included within the shell 121, said aperture 162 receiving said extendable knife 150 and where said exacto knife 150 is attached to the slide bar 161 by an attachment means such as a blade pin 151 and where the thumb control 160 is operable in a horizontal plane and is particularly handy for thumb operation.

Additionally, the base 130 further includes a thumb saddle 124, at least one guide pin aperture 125, and at least one retainer detent 126 where the thumb saddle 124 is further defined as an arcuate structure with an upward curve and shaped and sized for matingly receiving a person's finger appendage and is located at the middle of the shell 121 and where the at least one guide pin aperture 125 is further defined as elongated holes which run through the base 130 toward the handle 120 and where the at least one retainer detent 126 is further defined as a recess aperture preferably located at a middle of the base 130.

Additionally, the Handle Cutter Assembly 110 can further include a tool die stand 170 which is comprised of a base rib 171, a support wall 172, an upper flange 173, a retainer pimple 174, at least one guide post 175, and a tool die aperture 176 where the base rib 171, the support wall 172, and the upper flange 173 are integrally attached to one another and the support wall 172 is located between the base rib 171 and the upper flange 173 and where the at least one guide post 175 is fixedly attached to the upper flange 173 and protrudingly extends outwardly away from the support wall 172 and the base rib 171 and where the tool die aperture 176 is therefore formed at an inner periphery of the support wall 172 and the base rib 171 and where the retainer pimple 174 is a slight protrusion extending laterally from an upper outer periphery of the cutter 140 and is preferrably located at a middle of the cutter 140.

The at least one guide post 175 is designed to be matingly received by the at least one guide pin aperture 125 and the retainer pimple 174 is designed to be received by the at least one retainer detent 126 and where the at least one retainer detent 126 holds the tool die stand 170 onto the handle 120 and the base 130.

In use, the Handle Cutter Assembly 110 is pushed against a wall of material such as cardboard or the like. Since the surface area of the cutting edge initially contacting the surface of the material to be cut is reduced due to the high or pointed edges along with the low edges or crevices, the cutter readily penetrates the surface of the material. As the cutter is pushed through the material, the low edges approach and eventually cut as well. The cutter 140 does not go completely around as in an oval, but rather it is shaped like a "C" and has one side left open. This remaining open side consequently does not cut the material adjacent to this area of the cutter 140 for the purpose of leaving the material intact and to be folded over. Furthermore, the remaining open side can include a row of cutter points 143 which produce a perforated line at a fold point allowing the material left to be folded over more easily. In some cases, this remaining flap can still be relied upon to hold material into the box and it can also serve as a more pleasant edge for the hand to lift against. The Handle Cutter Assembly 110 can effectively be used either side up or by either the right hand or the left hand to create handle holes and flaps to the advantage of the user according to the material being carried or packed inside the box or object.

Additionally and more specifically, it will be noted that a basic alternate embodiment of the Handle Cutter Assembly 10 comprises a handle 20, a base 30, a cutter 40, and an extendable knife 50 controlled by a thumb control 60.

As best illustrated in FIGS. 7 through 12, it can be shown that the handle 20 is an integral part of the base 30 and is an extension thereof on one side of the base 30, and the cutter 40 is also an integral part of the base 30 and extends in a direction opposite of the handle 20 from the base 30. The handle 20 further comprises a shell which is formed by a left shell 22 and a right shell 23 which are joined together. The cutter 40 is fastened to the base 30 on a side opposite the handle 20. The cutter 40 is formed with a cutting edge that is formed with high edges 41 and low edges 42 such that only high points 141 initially contact the surface being cut when the hand cutter assembly is used. The handle further includes an extendable knife 50 for use in additional cutting. The extendable knife 50 is retractable by operation of a thumb control 60. The thumb control 60 further comprises a slide bar 61 which extends away from the thumb and forms an aperture 62 at one end, said aperture 62 receiving said extendable knife 50 and where said exacto knife 50 is attached to the slide bar 61 by an attachment means such as a blade pin 51.

In use, the Handle Cutter Assembly is pushed against a wall of material such as cardboard or the like. Since the surface area of the cutting edge initially contacting the surface of the material to be cut is reduced due to the high 41 or pointed edges along with the low edges 42, the cutter 40 readily penetrates the surface of the material. As the cutter 40 is pushed through the material, the low edges 42 approach and eventually cut as well. The cutter 40 does not go completely around as in an oval, but rather it is shaped like a "C" and has one side left open. This remaining open side consequently does not cut the material adjacent to this area of the cutter 40 for the purpose of leaving the material in tact and to be folded over. In some cases, this remaining flap can still be relied upon to hold material into the box and it can also serve as a more pleasant edge for the hand to lift against. The Handle Cutter Assembly 10 can effectively be used either side up or by either the right hand or the left hand to create handle holes and flaps to the advantage of the user according to the material being carried or packed inside the box or object.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A handle cutter assembly comprising:

a base, a handle, and a cutter;

wherein the handle is an integral part of the base and is an extension thereof on one side of the base, and the cutter is also an integral part of the base and extends in a direction opposite to the base and to the handle, wherein the handle further comprises a shell which is formed by a left shell and a right shell which are joined together, wherein the cutter is fastened to the base on a side opposite the handle, wherein the cutter is formed with a cutting edge that is formed with high edges and low such that only the high edges initially contact a surface being cut when the cutter assembly is used, wherein the handle further includes an extendable knife for use in additional cutting, wherein the extendable knife is controlled in extending and retracting by a thumb control, wherein the thumb control further comprises a slide bar adapted to extend away from a thumb of a user and forms an aperture at one end, said aperture receiving said extendable knife and where said extendable knife is attached to the slide bar by an attachment means, wherein the cutter has a start and a stop allowing it to cut "C" shaped handle holes in a variety of materials.

2. The handle cutter assembly of claim 1, wherein the slide bar which extends away from the thumb through said aperture included within the shell, and where said attachment means includes a blade pin and where the thumb control is operable in a horizontal plane.

3. The handle cutter assembly of claim 1, wherein the base further includes a thumb saddle, at least one guide pin aperture, and at least one retainer detent where the thumb saddle is further defined as an arcuate structure with an upward curve and is attachedly located at the middle of the shell and where the at least one guide pin aperture is further defined as elongated holes which run through the base toward the handle and where the at least one retainer detent is further defined as a recess aperture located at a middle of the base.

4. The handle cutter assembly of claim 3, wherein a tool die stand comprised of a base rib, a support wall, an upper flange, a retainer pimple, at least one guide post, and a tool die aperture where the base rib, the support wall, and the upper flange are integrally attached to one another and the support wall is located between the base rib and the upper flange and where the at least one guide post is fixedly attached to the upper flange and protrudingly extends outwardly away from the support wall and the base rib and where the tool die aperture is therefore formed at an inner periphery of the support wall and the base rib and where the retainer pimple is a slight protrusion extending laterally from an upper outer periphery of the cutter and is located at a middle of the cutter.

5. The handle cutter assembly of claim 4, wherein said at least one guide post is designed to be matingly received by said at least one guide pin aperture and the retainer pimple is designed to be matingly received by the at least one retainer detent and where the at least one retainer detent holds the tool die stand onto the handle and the base.

6. A handle cutter assembly comprising:

a base, a handle, and a cutter;

wherein the handle is an integral part of the base and is an extension thereof on one side of the base, and the cutter is also an integral part of the base and extends in a direction opposite to the base and to the handle, wherein the handle further comprises a shell which is formed by a left shell and a right shell which are joined together, wherein the cutter is fastened to the base on a side opposite the handle, wherein the cutter is formed with a cutting edge that is formed with high edges and low edges such that only the high edges initially contact a surface being cut when the cutter assembly is used.

7. The handle cutter assembly of claim 6, wherein the handle further includes an extendable knife for use in additional cutting, wherein the extendable knife is controlled in extending and retracting by a thumb control, wherein the thumb control further comprises a slide bar adapted to extend away from a thumb of a user and forms an aperture at one end, said aperture receiving said extendable knife and where said extendable knife is attached to the slide bar by an attachment means.

8. The handle cutter assembly of claim 6, wherein the cutter has a start and a stop allowing it to cut "C" shaped handle holes in a variety of materials.

9. A handle cutter assembly comprising:

a base, a handle, and a cutter;

wherein the handle is an integral part of the base and is an extension thereof on one side of the base, and the cutter is also an integral part of the base and extends in a direction opposite to the base and to the handle; and wherein the cutter is formed with a cutting edge that is formed with high edges and low edges such that only the high edges initially contact a surface being cut when the cutter assembly is used.

10. The handle cutter assembly of claim 9, wherein the handle further comprises a shell which is formed by a left shell and a right shell which are joined together.

11. The handle cutter assembly of claim 9, wherein the cutter is fastened to the base on a side opposite the handle.

12. The handle cutter assembly of claim 9, wherein the handle further includes an extendable knife for use in additional cutting.

13. The handle cutter assembly of claim 12, wherein the extendable knife is controlled in extending and retracting by a thumb control.

14. The handle cutter assembly of claim 13, wherein the thumb control further comprises a slide bar adapted to extend away from a thumb of a user and forms an aperture at one end, said aperture receiving said extendable knife and where said extendable knife is attached to the slide bar by an attachment means.

15. The handle cutter assembly of claim 9, wherein the cutter has a start and a stop allowing it to cut "C" shaped handle holes in a variety of materials.

* * * * *